US009214260B2

(12) United States Patent
Ishikawa et al.

(10) Patent No.: US 9,214,260 B2
(45) Date of Patent: Dec. 15, 2015

(54) DIFFERENTIAL SIGNAL TRANSMISSION CABLE AND MULTI-CORE DIFFERENTIAL SIGNAL TRANSMISSION CABLE

(71) Applicant: Hitachi Cable, Ltd., Tokyo (JP)

(72) Inventors: Hiroshi Ishikawa, Hitachi (JP); Takahiro Sugiyama, Hitachi (JP); Takashi Kumakura, Hitachinaka (JP)

(73) Assignee: HITACHI METALS, LTD., Tokyo (JP)

( * ) Notice: Subject to any disclaimer, the term of this patent is extended or adjusted under 35 U.S.C. 154(b) by 218 days.

(21) Appl. No.: 13/852,936

(22) Filed: Mar. 28, 2013

(65) Prior Publication Data

US 2014/0102756 A1 Apr. 17, 2014

(30) Foreign Application Priority Data

Oct. 12, 2012 (JP) ..... 2012-226823

(51) Int. Cl.

| | |
|---|---|
| ***H01B 7/00*** | (2006.01) |
| ***H01B 7/30*** | (2006.01) |
| ***H01B 11/18*** | (2006.01) |
| *H01B 11/12* | (2006.01) |
| *H01B 11/20* | (2006.01) |

(52) U.S. Cl.

CPC ..... *H01B 7/30* (2013.01); *H01B 11/1895* (2013.01); *H01B 11/12* (2013.01); *H01B 11/20* (2013.01)

(58) Field of Classification Search

USPC ..... 174/102 R, 102 SP, 106 R, 36, 110 R, 174/113 R, 117 R, 120 R

See application file for complete search history.

(56) References Cited

U.S. PATENT DOCUMENTS

| | | | | | |
|---|---|---|---|---|---|
| 3,691,488 | A | * | 9/1972 | Holtum, Jr. | 333/237 |
| 4,129,841 | A | * | 12/1978 | Hildebrand et al. | 333/237 |
| 4,325,039 | A | * | 4/1982 | Allebone | 333/237 |
| 4,366,457 | A | * | 12/1982 | Bode et al. | 333/237 |
| 4,800,351 | A | * | 1/1989 | Rampalli et al. | 333/237 |
| 5,276,413 | A | * | 1/1994 | Schulze-Buxloh | 333/237 |
| 5,422,614 | A | * | 6/1995 | Rampalli et al. | 333/237 |

(Continued)

FOREIGN PATENT DOCUMENTS

| | | |
|---|---|---|
| JP | U-02-047724 | 4/1990 |
| JP | 2008-41454 A | 2/2008 |

(Continued)

OTHER PUBLICATIONS

Japanese Office Action dated Jul. 28, 2015 with English translation.

*Primary Examiner* — William H Mayo, III

(57) ABSTRACT

A differential signal transmission cable includes first and second signal lines arranged parallel to each other, a conductive layer made of a conductor in which a current is induced when signals propagate through the first and second signal lines, and a dielectric disposed between the first and second signal lines and the conductive layer. The conductive layer has a signal attenuating structure including a non-continuous section in which the conductor is non-continuous, the non-continuous section being located such that, among differential signal components and common-mode signal components included in the signals propagating through the first and second signal lines, the common-mode signal components are attenuated by an attenuation factor greater than an attenuation factor of the differential signal components.

19 Claims, 10 Drawing Sheets

(56) References Cited

U.S. PATENT DOCUMENTS

| | | | | |
|---|---|---|---|---|
| 5,473,336 | A * | 12/1995 | Harman et al. | 343/790 |
| 5,898,350 | A * | 4/1999 | Aberasturi | 333/237 |
| 6,292,072 | B1 * | 9/2001 | Bode et al. | 333/237 |
| 2006/0048961 | A1 * | 3/2006 | Pfeiler et al. | 174/36 |
| 2007/0037419 | A1 * | 2/2007 | Sparrowhawk | 439/98 |

FOREIGN PATENT DOCUMENTS

| | | | |
|---|---|---|---|
| JP | 2008-310088 | A | 12/2008 |
| JP | 2012-018764 | A | 1/2012 |
| JP | 2012-64777 | A | 3/2012 |

* cited by examiner

DIFFERENTIAL SIGNAL TRANSMISSION CABLE AND MULTI-CORE DIFFERENTIAL SIGNAL TRANSMISSION CABLE

The present application is based on Japanese patent application No. 2012-226823 filed on Oct. 12, 2012, the entire contents of which are incorporated herein by reference.

BACKGROUND OF THE INVENTION

1. Field of the Invention

The present invention relates to a differential signal transmission cable including a pair of conductive wires that transmit differential signals and a multi-core differential signal transmission cable including a plurality of differential signal transmission cables.

2. Description of the Related Art

Differential signal transmission cables used for high-speed digital communication at several gigahertz or more between information processing apparatuses, such as computers, and multi-core differential signal transmission cables which each include a plurality of differential signal transmission cables are known. Some of these differential-signal cables have a structure for suppressing suck-out, which is a phenomenon that signals attenuate in a high-frequency band (see, for example, Japanese Unexamined Patent Application Publication No. 2012-18764 (hereinafter referred to as Patent Document 1)).

Patent Document 1 describes a differential signal transmission cable in which a pair of signal lines arranged parallel to each other are covered with an insulator and the outer periphery of the insulator is covered with a first piece of composite tape and a second piece of composite tape. The first and second pieces of composite tape each include a vapor-deposited metal layer, and are wrapped around the insulator such that the respective vapor-deposited metal layers are in contact with each other. The first piece of composite tape is helically wrapped around the outer periphery of the insulator with the vapor-deposited metal layer thereof facing outward. The second piece of composite tape is longitudinally wrapped around the outer periphery of the first piece of composite tape with the vapor-deposited metal layer thereof facing inward.

Since the first piece of composite tape is helically wrapped around the outer periphery of the insulator, a gap between the insulator and the first piece of composite tape is reduced. Accordingly, a difference in propagation delay time between the pair of signal lines, that is, an intra-pair skew, is reduced. Since the second piece of composite tape is longitudinally wrapped around the outer periphery of the first piece of composite tape such that the vapor-deposited metal layers are in contact with each other, a shield current flows through the first and second pieces of composite tape in a longitudinal direction of the pair of signal lines. As a result, the suck-out is suppressed.

SUMMARY OF THE INVENTION

In communication using differential signal transmission cables, common-mode signals may be applied to the pair of signal lines in a superposed manner owing to, for example, differences in characteristics of elements included in a transmission circuit of an apparatus at a transmission side. The common-mode signals may also be generated when, for example, the differential signal transmission cable is long and the differential signals are converted into the common-mode signals owing to the intra-pair skew in the differential signal transmission cable. When the common-mode signals reach a reception side, signal extraction based on the potential difference between the pair of signal lines may not be performed correctly and a bit error rate increases. As a result, re-transmission of the signals will be necessary and the actual communication speed will be reduced. When, for example, the communication speed is 10 Gbit/sec, the time period corresponding to a signal of 1 bit is 100 ps. As the signal transmission speed increases, the rate of bit errors due to the common-mode signals caused by, for example, slight differences between signal arrival times at the reception side increases.

The differential signal transmission cable described in Patent Document 1 has no countermeasures against the common-mode signals, and there is still room for improvement. Specifically, although the attenuation factor of the differential signals is reduced by suppressing the suck-out, the attenuation factor of the common-mode signals is also reduced at the same time. Thus, the common-mode signals cannot be selectively attenuated.

Accordingly, an object of the present invention is to provide a differential signal transmission cable and a multi-core differential signal transmission cable capable of reducing a bit error rate by attenuating common-mode signals that propagate through a pair of signal lines.

To achieve the above-described object, according to an aspect of the present invention, a differential signal transmission cable includes a pair of signal lines arranged parallel to each other, a conductive layer made of a conductor in which a current is induced when signals propagate through the pair of signal lines, and a dielectric disposed between the pair of signal lines and the conductive layer. The conductive layer has a signal attenuating structure including a non-continuous section in which the conductor is non-continuous, the non-continuous section being located such that, among differential signal components and common-mode signal components included in the signals propagating through the pair of signal lines, the common-mode signal components are attenuated by an attenuation factor greater than an attenuation factor of the differential signal components.

To achieve the above-described object, according to another aspect of the present invention, a multi-core differential signal transmission cable includes a plurality of the differential signal transmission cables, the differential signal transmission cables being collectively shielded together.

According to the differential signal transmission cable and the multi-core differential signal transmission cable of the aspects of the present invention, a bit error rate can be reduced by attenuating the common-mode signals that propagate through the pair of signal lines.

BRIEF DESCRIPTION OF THE DRAWINGS

The foregoing and other exemplary purposes, aspects and advantages will be better understood from the following detailed description of the invention with reference to the drawings, in which:

FIGS. 2A to 2C illustrate the structure of each differential signal transmission cable according to the first embodiment, wherein FIG. 2A is a perspective view of the differential signal transmission cable, FIG. 2B is a sectional view of FIG. 2A taken along line IIB-IIB, and FIG. 2C is a side view of a conductive layer viewed in a direction orthogonal to a direction in which first and second signal lines are arranged;

FIGS. 3A and 3B illustrate potential distributions generated in a dielectric when signals are supplied to a pair of signal lines, wherein FIG. 3A illustrates the case in which differential signals are supplied and FIG. 3B illustrates the case in which common-mode signals are supplied;

FIGS. 4A and 4B illustrate current distributions generated in an elliptic cylindrical conductive layer having no openings when an insulated electric wire is covered with the conductive layer, wherein FIG. 4A illustrates the case in which differential signals are supplied and FIG. 4B illustrates the case in which common-mode signals are supplied;

FIGS. 5A to 5C illustrate the structure of a differential signal transmission cable according to a second embodiment, wherein FIG. 5A is a perspective view of the differential signal transmission cable, FIG. 5B is a sectional view of FIG. 5A taken along line VB-VB, and FIG. 5C is a side view of a conductive layer viewed in a direction orthogonal to a direction in which first and second signal lines are arranged;

FIGS. 6A to 6C illustrate the structure of a differential signal transmission cable according to a third embodiment, wherein FIG. 6A is a perspective view of the differential signal transmission cable, FIG. 6B is a sectional view of FIG. 6A taken along line VIB-VIB, and FIG. 6C is a side view of a conductive layer viewed in a direction orthogonal to a direction in which first and second signal lines are arranged;

FIGS. 7A to 7D illustrate the structure of a differential signal transmission cable according to a fourth embodiment, wherein FIG. 7A is a perspective view of the differential signal transmission cable, FIG. 7B is a sectional view of FIG. 7A taken along line VIIB-VIIB, FIG. 7C is a perspective view of a piece of tape included in the differential signal transmission cable, and FIG. 7D is a side view of a conductive layer viewed in a direction orthogonal to a direction in which first and second signal lines are arranged;

FIGS. 8A to 8C illustrate the structure of a differential signal transmission cable according to a fifth embodiment, wherein FIG. 8A is a perspective view of the differential signal transmission cable, FIG. 8B is a sectional view of FIG. 8A taken along line VIIIB-VIIIB, and FIG. 8C is a side view of a conductive layer viewed in a direction orthogonal to a direction in which first and second signal lines are arranged;

FIGS. 9A to 9C illustrate the structure of a differential signal transmission cable according to a sixth embodiment, wherein FIG. 9A is a perspective view of the differential signal transmission cable, FIG. 9B is a sectional view of FIG. 9A taken along line IXB-IXB, and FIG. 9C is a side view of a conductive layer viewed in a direction orthogonal to a direction in which first and second signal lines are arranged.

DESCRIPTION OF THE PREFERRED EMBODIMENTS

Figure 1:
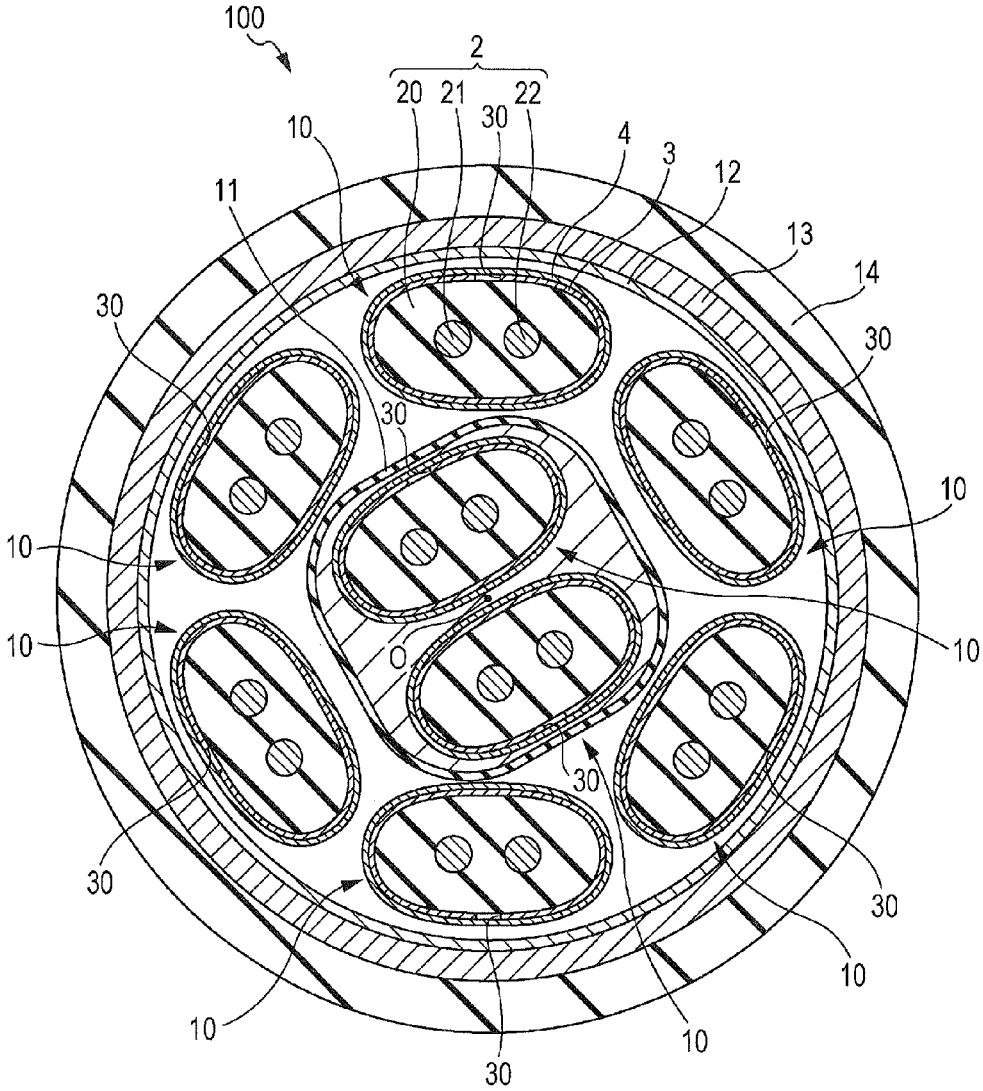
FIG. 1 is a sectional view illustrating a cross sectional structure of a multi-core differential signal transmission cable including a plurality of differential signal transmission cables according to a first embodiment of the present invention.

Referring now to the drawings, and more particularly to FIGS. 1-10B, there are shown exemplary embodiments of the methods and structures according to the present invention.

First Embodiment

FIG. 1 is a sectional view illustrating a cross sectional structure of a multi-core differential signal transmission cable 100 including a plurality of differential signal transmission cables 10 according to a first embodiment of the present invention.

The multi-core differential signal transmission cable 100 includes a bundle of differential signal transmission cables 10 (eight differential signal transmission cables 10 in the example illustrated in FIG. 1), which are collectively shielded together by a shield conductor 12. The outer periphery of the shield conductor 12 is covered with a braided wire tube 13. The differential signal transmission cables 10, the shield conductor 12, and the braided wire tube 13 are disposed in a sheath 14 that is made of an insulator.

In the example illustrated in FIG. 1, two of the differential signal transmission cables 10 are arranged in a central area of the multi-core differential signal transmission cable 100, and are disposed in a cylindrical enclosure 11 made of, for example, twine or foamed polyolefin. The remaining six differential signal transmission cables 10 are arranged outside the enclosure 11 with substantially constant intervals therebetween.

Each differential signal transmission cable 10 includes an insulated electric wire 2 in which a pair of signal lines (a first signal line 21 and a second signal line 22) are covered with a dielectric 20, a conductive layer 3 formed of a conductor and arranged so as to cover the outer periphery of the dielectric 20, and a jacket 4 that covers the conductive layer 3.

The conductive layer 3 has a plurality of openings 30, which will be described below, formed therein. The six differential signal transmission cables 10 disposed outside the enclosure 11 are arranged so that the openings 30 formed therein face outward (toward the shield conductor 12). The two differential signal transmission cables 10 disposed in the enclosure 11 are arranged so that the openings 30 formed therein face in opposite directions (toward the enclosure 11). Thus, the differential signal transmission cables 10 are arranged so that the openings 30 face outward with respect to the center O of the multi-core differential signal transmission cable 100, that is, so that the openings 30 do not face other differential signal transmission cables 10.

Each differential signal transmission cable 10 propagates two signals having a phase difference of 180 degrees (differential signals) through the first and second signal lines 21 and 22 from a transmission side to a reception side. A signal corresponding to the difference between the two signals is extracted at the reception side.

Structure of Differential Signal Transmission Cable 10

Figure 2A:
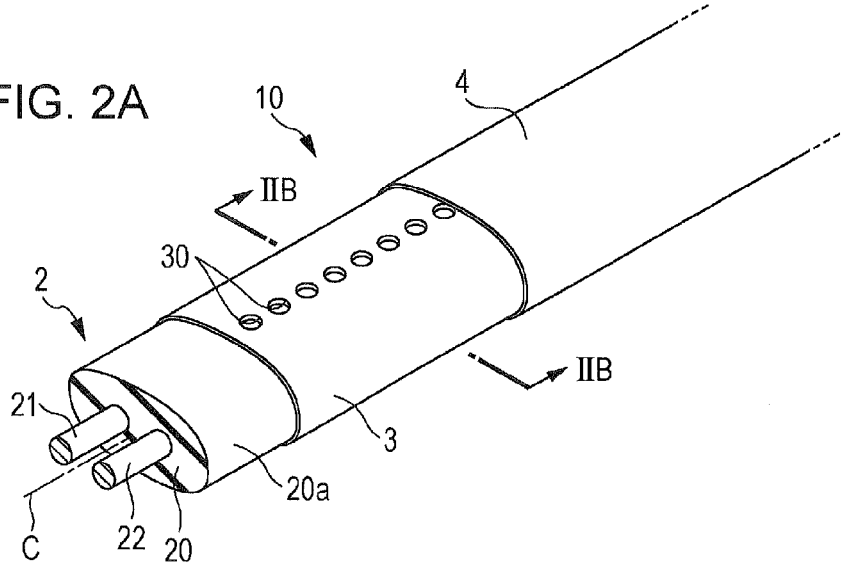
Figure 2B:
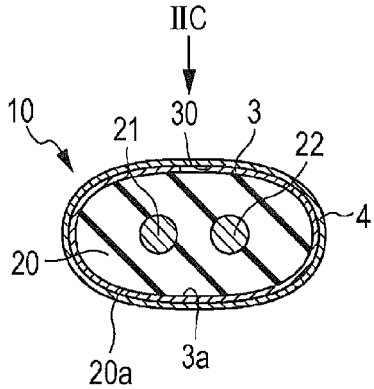
Figure 2C:
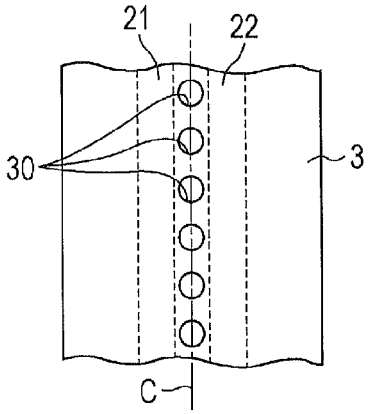

FIGS. 2A to 2C illustrate the structure of each differential signal transmission cable 10 according to the present embodiment. FIG. 2A is a perspective view of an end portion of the differential signal transmission cable 10. FIG. 2B is a sectional view of FIG. 2A taken along line IIB-IIB. FIG. 2C is a side view of the conductive layer 3 viewed in a direction orthogonal to a direction in which the first and second signal lines 21 and 22 are arranged. In FIG. 2A, for the purpose of explanation, the dielectric 20, the conductive layer 3, and the jacket 4 are partially removed so that the internal structures thereof are exposed. In FIG. 2C, the first and second signal lines 21 and 22 disposed in the dielectric 20 are shown by dashed lines.

The first and second signal lines 21 and 22 are each formed of a single-core wire or a stranded wire made of, for example, copper and are arranged parallel to each other with a certain interval therebetween. The coupling ratio between the first and second signal lines 21 and 22 is, for example, 0.1 to 0.3.

The insulated electric wire 2 is formed by covering the first and second signal lines 21 and 22 together with the dielectric 20. The dielectric 20 may be formed of an insulator made of, for example, foamed polyethylene or a Teflon-based material (Teflon is a registered trademark) such as foamed Teflon or tetrafluoroethylene hexafluoropropylene copolymer (FEP).

The dielectric 20 is disposed between the first and second signal lines 21 and 22 and the conductive layer 3. The outer rim of the dielectric 20 in cross section orthogonal to the central axis C of the insulated electric wire 2 has an elliptical shape. Specifically, the outer periphery of the dielectric 20 in cross section orthogonal to the central axis C is convexly curved and extends continuously so as to form an oval shape whose diameter in a first direction in which the first and second signal lines 21 and 22 are arranged is greater than the diameter thereof in a second direction that is orthogonal to the first direction. In other words, the outer periphery of the dielectric 20 is formed of a continuous convexly curved surface that is entirely smooth and has no flat or recessed portions.

The conductive layer 3 is formed of an elliptic cylindrical conductor that induces a current when the signals propagate through the first and second signal lines 21 and 22. The conductor may be made of, for example, a highly conductive metal such as copper or aluminum. The conductive layer 3 has an inner peripheral surface 3*a* that is in contact with an outer peripheral surface 20*a* of the dielectric 20.

The conductive layer 3 has a signal attenuating structure such that, among differential signal components and common-mode signal components included in the signals that propagate through the first and second signal lines 21 and 22, the common-mode signal components are attenuated by an attenuation factor greater than that of the differential signal components. In the present embodiment, this signal attenuating structure is realized by forming the openings 30 arranged in the longitudinal direction of the insulated electric wire 2. The openings 30 are holes (through holes) at which the outer peripheral surface 20*a* of the dielectric 20 is exposed to the outside, and serve as non-continuous sections of the conductor that forms the conductive layer 3. The inner areas of the openings 30 are not filled with conductors, and serve as non-conductive areas that do not conduct a current. The openings 30 may be formed by, for example, laser processing.

As illustrated in FIG. 2C, when the conductive layer 3 is viewed in a direction (direction shown by arrow IIC in FIG. 2B) that is orthogonal to the direction in which the first and second signal lines 21 and 22 are arranged, the openings 30 are formed in an area between the first and second signal lines 21 and 22. In the present embodiment, the openings 30 have a circular shape and are arranged with substantially constant intervals therebetween. Accordingly, a conductor is interposed between every two openings 30 that are adjacent to each other in the longitudinal direction of the insulated electric wire 2. The shape of the openings 30 is not limited to a circular shape, and may instead be an elliptical shape or a polygonal shape such as a triangular shape or a rectangular shape. The openings 30 may have a uniform size or different sizes.

In the present embodiment, as illustrated in FIG. 2C, the centers of the openings 30 are aligned with the center axis C when viewed in the direction of arrow IIC. However, the centers of the openings 30 may instead be displaced from the central axis C toward the first signal line 21 or the second signal line 22. The entireties of the openings 30 are preferably disposed in the area between the first and second signal lines 21 and 22 when viewed in the direction of arrow IIC. However, the common-mode signal components may be attenuated by an attenuation factor greater than that of the differential signal components as long as the openings 30 are at least partially disposed in the area between the first and second signal lines 21 and 22.

The reason why the common-mode signal components are attenuated by an attenuation factor greater than that of the differential signal components owing to the openings 30 will now be described with reference to FIGS. 3A, 3B, 4A, and 4B.

Figure 3A:
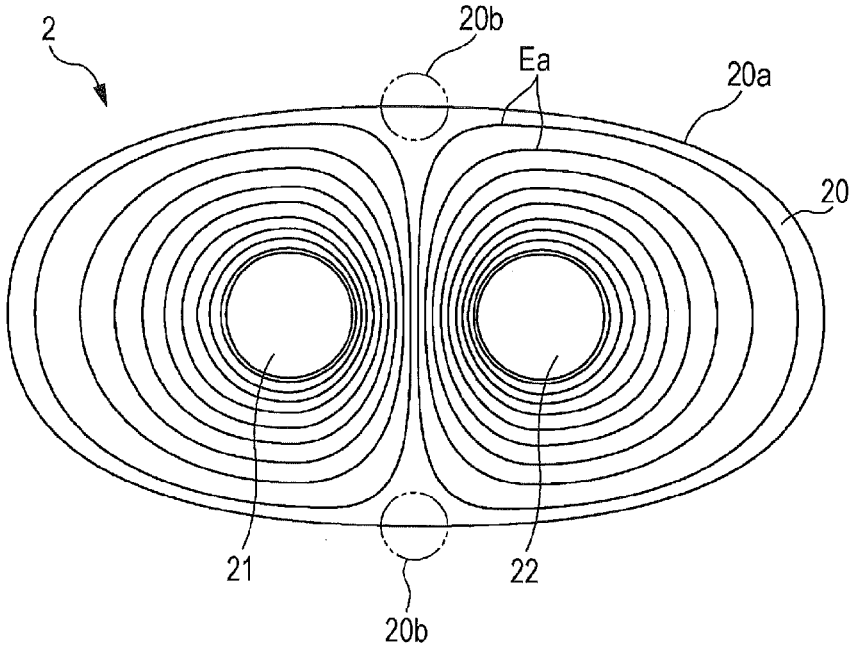
Figure 3B:
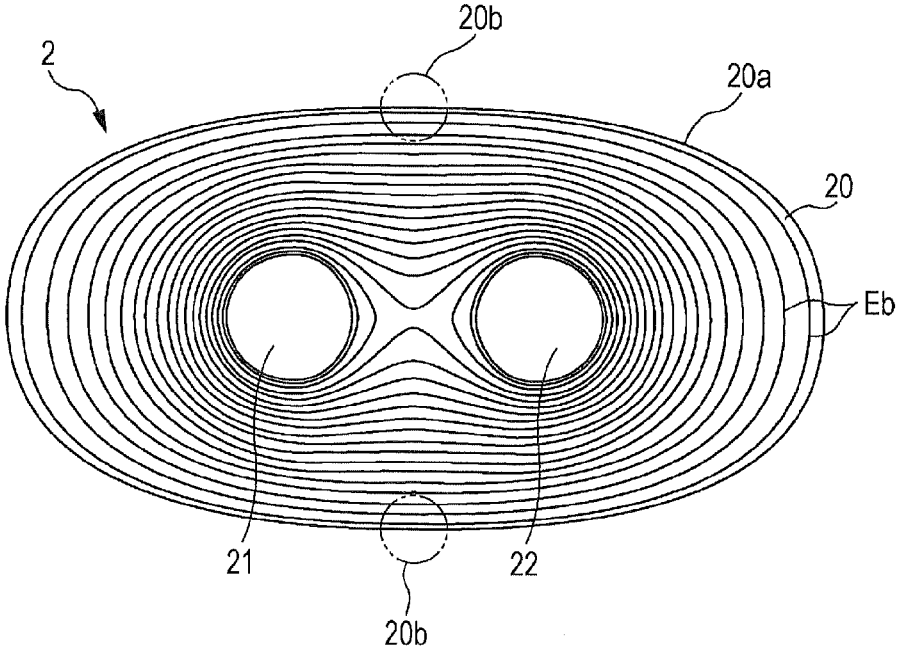

FIG. 3A illustrates a potential distribution, represented by equipotential lines Ea, in the dielectric 20 when differential signals having a phase difference of 180 degrees are supplied to the first and second signal lines 21 and 22 in the insulated electric wire 2 that is not covered with the conductive layer 3. FIG. 3B illustrates a potential distribution, represented by equipotential lines Eb, in the dielectric 20 when common-mode signals not having a phase difference of 180 degrees are supplied to the first and second signal lines 21 and 22 in the insulated electric wire 2 that is not covered with the conductive layer 3. In FIGS. 3A and 3B, the smaller the intervals between the equipotential lines Ea and Eb, the larger the electric field amplitude during signal propagation.

Figure 4A:
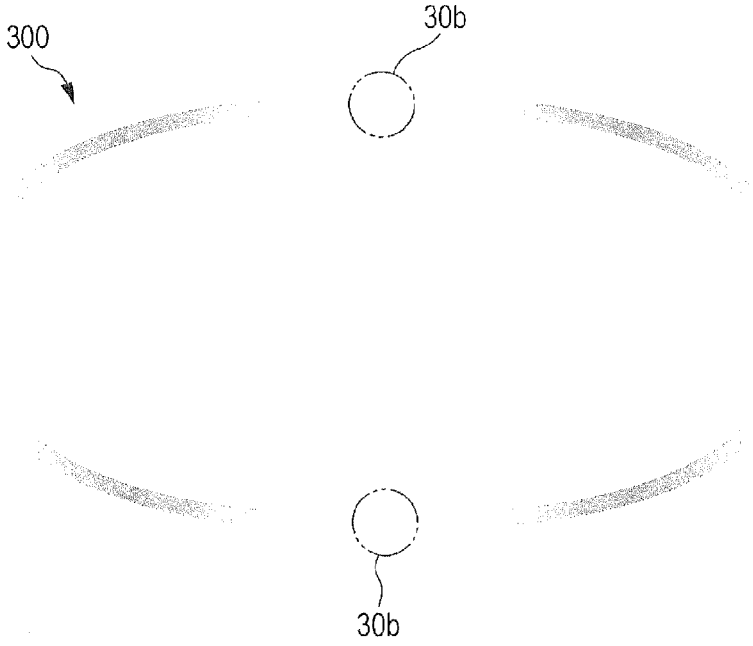
Figure 4B:
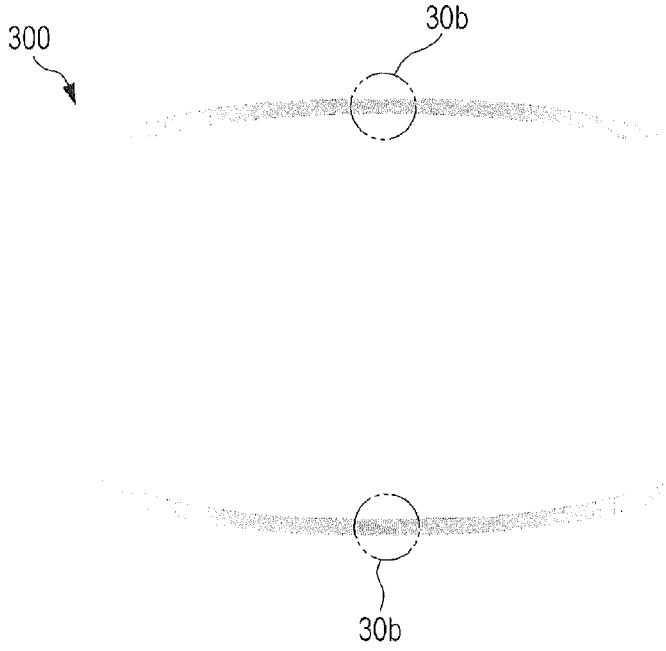

FIG. 4A illustrates a current distribution generated in an elliptic cylindrical conductive layer 300 having no openings 30 when the outer peripheral surface 20*a* of the insulated electric wire 2 is covered with the conductive layer 300 and the differential signals having a phase difference of 180 degrees are supplied to the first and second signal lines 21 and 22. FIG. 4B illustrates a current distribution generated in the conductive layer 300 when the common-mode signals are supplied to the first and second signal lines 21 and 22 in the insulated electric wire 2 covered with the conductive layer 300. In FIGS. 4A and 4B, the current intensity is represented by a plurality of steps of gradation; areas where the current intensity is high are densely shaded and areas where the current intensity is low are lightly shaded. The current intensity increases as the electric field amplitude increases.

Referring to FIGS. 3A and 3B, the electric field amplitude in outer peripheral portions 20*b* of the dielectric 20 that are equally spaced from the first and second signal lines 21 and 22 is greater in the case where the common-mode signals are supplied to the first and second signal lines 21 and 22 (see FIG. 3B) than in the case where the differential signals are supplied to the first and second signal lines 21 and 22 (see FIG. 3A). Referring to FIGS. 4A and 4B, the current intensity in minor-axis end portions 30*b* of the conductive layer 300 that correspond to the outer peripheral portions 20*b* of the dielectric 20 is greater in the case where the common-mode signals are supplied to the first and second signal lines 21 and 22 (see FIG. 4B) than in the case where the differential signals are supplied to the first and second signal lines 21 and 22 (see FIG. 4A).

The openings 30, which are non-continuous sections of the conductor, are formed in the region in which the current intensity is high in the case where the common-mode signals are supplied. Therefore, the current induced in the conductive layer 3 by the common-mode signals is disrupted and the energy of the common-mode signals is reduced as a result of reflection in the cable and radiation to the outside of the cable. Thus, the common-mode signals are attenuated. In contrast, the influence of the openings 30 on the differential signals is relatively small and the attenuation factor of the differential signals is smaller than that of the common-mode signals. Thus, the common-mode signals can be selectively attenuated owing to the openings 30.

In the present embodiment, the openings 30 are formed at one end of the conductive layer 3 having the elliptical shape in the minor-axis direction. However, the openings 30 may instead be formed in a plurality of lines at both ends in the minor-axis direction (in regions corresponding to the minor-axis end portions 30*b* in FIGS. 4A and 4B). In this case, the attenuation factor of the common-mode signals further increases. In the case where the conductive layer 3 is longitudinally wrapped around the dielectric 20, the conductive layer 3 may be arranged such that edge portions thereof in the width direction overlap each other at a position opposite the region in which the openings 30 are formed. In this case, the openings 30 are formed at one end of the conductive layer 3 having the elliptical shape in the minor-axis direction and the overlapping portion is formed at the other end of the conductive layer 3 in the minor-axis direction.

Effects and Advantages of First Embodiment

The following effects and advantages can be obtained by the above-described first embodiment.

(1) Owing to the signal attenuating structure including the openings 30, the common-mode signals can be selectively attenuated while suppressing attenuation of the differential signals. Even when common-mode signal components are generated for some reason in the signals that propagate through the first and second signal lines 21 and 22, the common-mode signal components are attenuated as they propagate through the differential signal transmission cables 10. Accordingly, the common-mode signal components included in the signals received at the reception side can be reduced. As a result, the bit error rate at the reception side can be reduced.

(2) The openings 30 are formed in a region in which the electric field amplitude and the current intensity are greater in the case where the common-mode signals propagate through the first and second signal lines 21 and 22 than in the case where the differential signals propagate through the first and second signal lines 21 and 22. Specifically, the openings 30 are formed in an area between the first and second signal lines 21 and 22 when the conductive layer 3 is viewed in the direction of arrow IIC in FIG. 2B. Therefore, the common-mode signal components can be effectively attenuated.

(3) The openings 30, which are non-continuous sections, of the conductive layer 3 can be easily formed by, for example, laser processing or punching, and it is not necessary to fill the openings 30 with an insulator or the like. Therefore, an increase in cost can be suppressed.

(4) Each of the differential signal transmission cables 10 included in the multi-core differential signal transmission cable 100 is arranged such that the openings 30 face outward with respect to the center O of the multi-core differential signal transmission cable 100. Therefore, influence of electromagnetic waves emitted from the openings 30 in each differential signal transmission cable 10 as noise on the signals that propagate through the other differential signal transmission cables 10 can be reduced.

Second Embodiment

A second embodiment of the present invention will now be described with reference to FIGS. 5A to 5C.

Figure 5A:
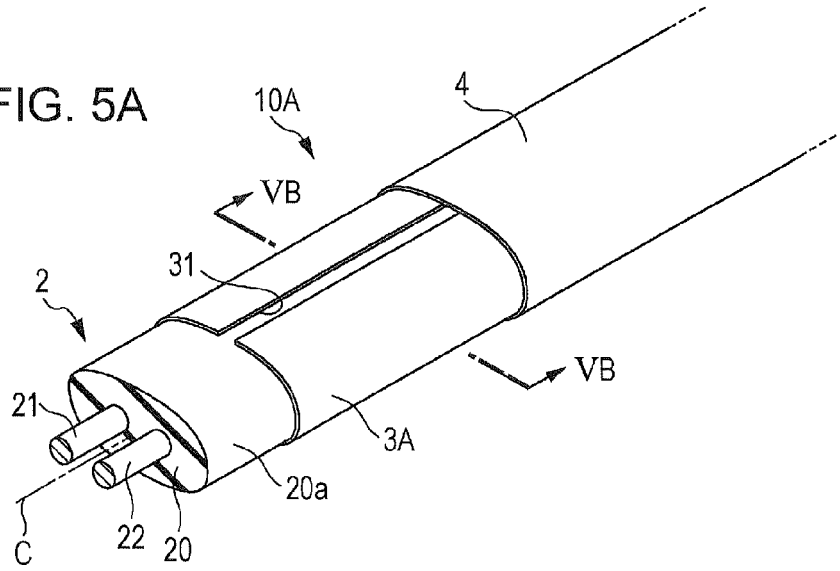
Figure 5B:
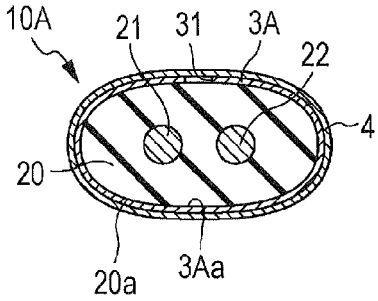
Figure 5C:
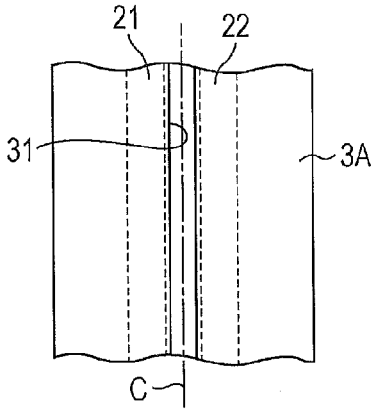

FIGS. 5A to 5C illustrate the structure of a differential signal transmission cable 10A according to the second embodiment. FIG. 5A is a perspective view of an end portion of the differential signal transmission cable 10A. FIG. 5B is a sectional view of FIG. 5A taken along line VB-VB. FIG. 5C is a side view of a conductive layer 3A viewed in a direction orthogonal to a direction in which first and second signal lines 21 and 22 are arranged. In FIGS. 5A to 5C, components having the same functions as those of the components described in the first embodiment are denoted by the same reference symbols, and explanations thereof are thus omitted.

In each differential signal transmission cable 10 according to the first embodiment, the openings 30 are formed in the conductive layer 3. In the differential signal transmission cable 10A according to the present embodiment, a linear slit 31 is formed in the conductive layer 3A as a non-continuous section of the conductor instead of the openings 30.

An inner peripheral surface 3Aa of the conductive layer 3A is in contact with the outer peripheral surface 20*a* of the dielectric 20. As illustrated in FIG. 5C, when the conductive layer 3A is viewed in a direction orthogonal to the direction in which the first and second signal lines 21 and 22 are arranged, the slit 31 is formed in an area between the first and second signal lines 21 and 22. In the present embodiment, the slit 31 has a constant width and extends parallel to the central axis C of the insulated electric wire 2.

In the present embodiment, the slit 31 is located so as to include a position that is equally spaced from the first and second signal lines 21 and 22. Specifically, when the conductive layer 3A is viewed in a direction orthogonal to the direction in which the first and second signal lines 21 and 22 are arranged, the slit 31 is located so as to overlap the central axis C.

As illustrated in FIG. 5C, the slit 31 may be arranged such that the center thereof in the width direction (circumferential direction of the insulated electric wire 2) coincides with the central axis C. However, the center of the slit 31 in the width direction may instead be displaced from the central axis C toward the first signal line 21 or the second signal line 22. The entirety of the slit 31 is preferably disposed in the area between the first and second signal lines 21 and 22 in the view shown in FIG. 5C. However, the common-mode signal components may be attenuated by an attenuation factor greater than that of the differential signal components as long as the slit 31 is at least partially disposed in the area between the first and second signal lines 21 and 22.

According to the present embodiment, the effects and advantages of items (1) and (2) described above in the first embodiment can be obtained. The slit 31 may be formed by using a metal conductor having a width smaller than the circumferential length of the outer peripheral surface 20*a* of the insulated electric wire 2 as the conductive layer 3A and wrapping the conductive layer 3A around the dielectric 20. Thus, the conductive layer 3A may be formed without performing any special process for forming the slit 31. In this case, the width of the slit 31 is equal to the difference between the width of the metal conductor used as the conductive layer 3A and the circumferential length of the outer peripheral surface 20*a*.

An auxiliary member for disrupting or absorbing an electromagnetic field may be arranged around the differential signal transmission cable 10A in the process of installing the differential signal transmission cable 10A. When large electromagnetic waves are emitted from the slit 31 or when the common-mode signal components cannot be sufficiently attenuated, the auxiliary member may be used to disrupt or absorb the electromagnetic field that leaks from the slit 31. Thus, the influence of the electromagnetic waves emitted from the slit 31 as noise on the signals that propagate through the other differential signal transmission cables can be reduced. The auxiliary member may be, for example, an electromagnetic-field absorbing sheet or an electromagnetic field shield made of metal. Alternatively, a cable that extends parallel to the differential signal transmission cable or an inner surface of a metal housing may be used as long as a problem of electromagnetic interference does not occur.

Third Embodiment

A third embodiment of the present invention will now be described with reference to FIGS. 6A to 6C.

Figure 6A:
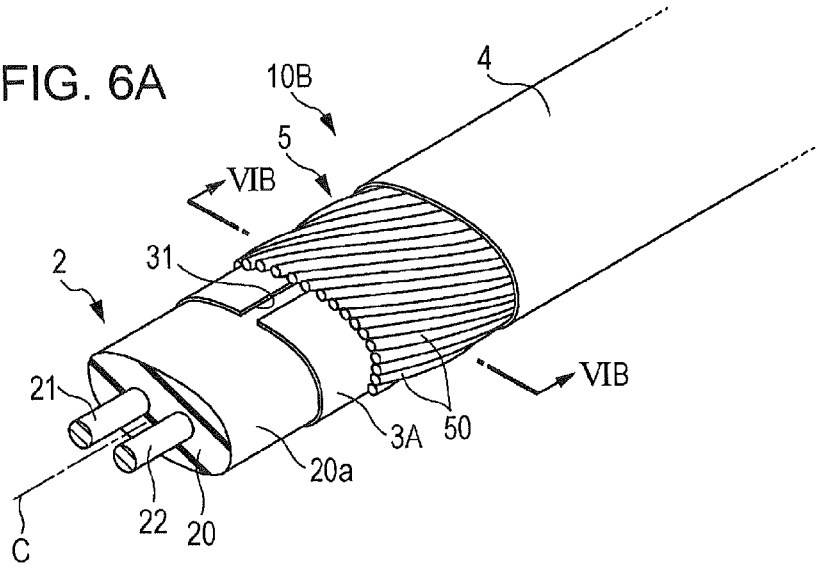
Figure 6B:
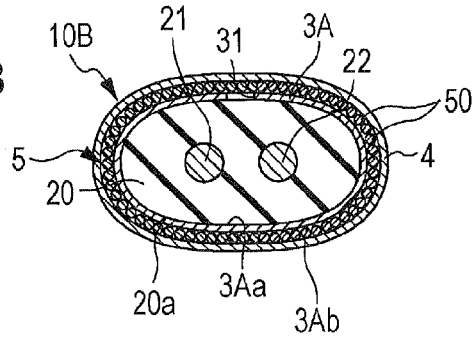
Figure 6C:
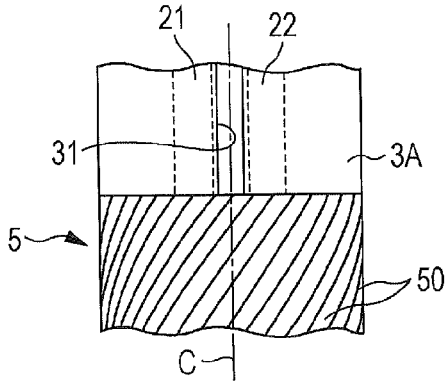

FIGS. 6A to 6C illustrate the structure of a differential signal transmission cable 10B according to the third embodiment. FIG. 6A is a perspective view of an end portion of the differential signal transmission cable 10B. FIG. 6B is a sectional view of FIG. 6A taken along line VIB-VIB. FIG. 6C is a side view of a conductive layer 3A viewed in a direction orthogonal to a direction in which first and second signal lines 21 and 22 are arranged. In FIGS. 6A to 6C, components having the same functions as those of the components described in the first and second embodiments are denoted by the same reference symbols, and explanations thereof are thus omitted.

The differential signal transmission cable 10B differs from the differential signal transmission cable 10A according to the second embodiment in that an outer conductive layer 5 including a plurality of helically wrapped conductor wires 50 is provided on the outer periphery of the conductive layer 3A.

The helically wrapped conductor wires 50 are linear conductors made of, for example, a highly conductive metal such as copper or aluminum, and are helically wrapped around the outer periphery of the conductive layer 3A. Each helically wrapped conductor wire 50 may be a single-core wire or a stranded wire obtained by twisting metal wires together. Although the outer conductive layer 5 is formed of multiple helically wrapped conductor wires 50 in the example illustrated in FIGS. 6A to 6C, the outer conductive layer 5 may instead be formed by helically winding a single conductor wire 50. The helically wrapped conductor wires 50 cover the slit 31 from the outer peripheral side of the conductive layer 3A, and extend in a direction inclined with respect to a direction parallel to the central axis C.

According to the present embodiment, the electromagnetic field that leaks from the slit 31 is disrupted by the outer conductive layer 5. Therefore, the energy of the common-mode signal components is reduced and the common-mode signal components are attenuated accordingly. Here, attenuation of the differential signal components is relatively small since leakage of the electromagnetic field generated by the differential signal components from the slit 31 is small. Accordingly, the common-mode signal components can be attenuated by an attenuation factor greater than that of the differential signal components. According to the present embodiment, the frequency characteristics of the attenuation of the common-mode signal components can be adjusted by adjusting the twisting pitch, or twisting angle, of the helically wrapped conductor wires 50. For example, when the twisting pitch of the helically wrapped conductor wires 50 is p (m) and the propagation velocity of the common-mode signals is v (m/s), common-mode signals having a frequency of v/(2p) (Hz) or less can be effectively attenuated.

According to the present embodiment, the common-mode signal components can be sufficiently attenuated without arranging an auxiliary member for disrupting or absorbing the electromagnetic field around the cable. In addition, the influence of the electromagnetic field that has leaked as noise on the signals that propagate through the other differential signal transmission cables can be reduced.

The differential signal transmission cable 10B may include the conductive layer 3 having the openings 30 (see FIGS. 2A to 2C) instead of the conductive layer 3A having the slit 31.

Fourth Embodiment

A fourth embodiment of the present invention will now be described with reference to FIGS. 7A to 7D.

Figure 7A:
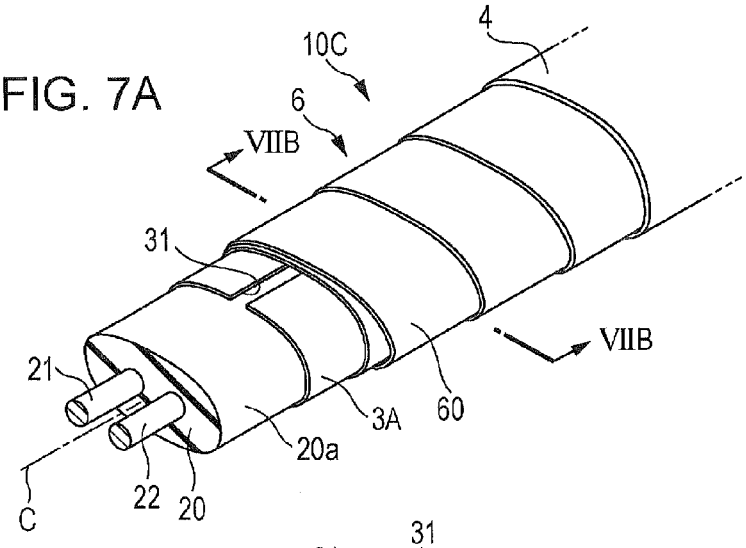
Figure 7B:
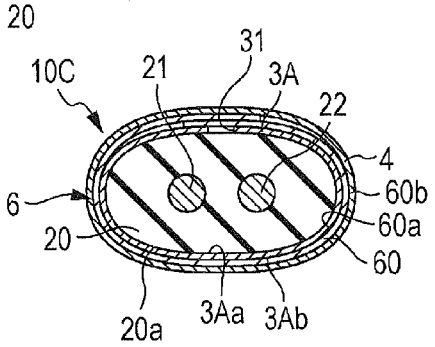
Figure 7C:
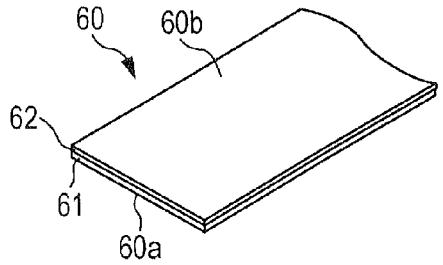
Figure 7D:
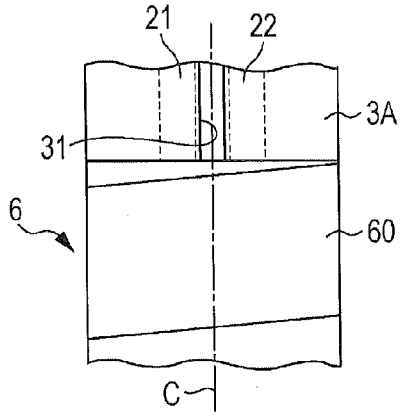

FIGS. 7A to 7D illustrate the structure of a differential signal transmission cable 10C according to the fourth embodiment. FIG. 7A is a perspective view of an end portion of the differential signal transmission cable 10C. FIG. 7B is a sectional view of FIG. 7A taken along line VIIB-VIIB. FIG. 7C is a perspective view of a piece of tape 60 included in the differential signal transmission cable 10C. FIG. 7D is a side view of a conductive layer 3A viewed in a direction orthogonal to a direction in which first and second signal lines 21 and 22 are arranged. In FIGS. 7A to 7D, components having the same functions as those of the components described in the first and second embodiments are denoted by the same reference symbols, and explanations thereof are thus omitted.

The differential signal transmission cable 10C differs from the differential signal transmission cable 10A according to the second embodiment in that an outer conductive layer 6 formed of the piece of tape 60, which is helically wound, is provided on the outer periphery of the conductive layer 3A.

Referring to FIG. 7C, the piece of tape 60 includes a resin layer 61 made of a flexible insulating resin such as polyethylene terephthalate (PET) and a metal layer 62 provided on one surface of the resin layer 61 and made of a highly conductive metal such as copper or aluminum. The resin layer 61 is closer to the conductive layer 3A than the metal layer 62 is, and a surface 60*a* of the piece of tape 60 on the resin-layer-61 side is in contact with an outer peripheral surface 3Ab of the conductive layer 3A. A surface 60*b* of the piece of tape 60 on the metal-layer-62 side is in contact with the jacket 4.

The thickness of the resin layer 61 is, for example, 3 μm or more and 20 μm or less, and the thickness of the metal layer 62 is, for example, 5 μm or more and 20 μm or less. The thickness of the resin layer 61, that is, the distance from the openings 30 to the metal layer 62 is preferably less than or equal to one-tenth of the wavelength of the common-mode signals that propagate through the first and second signal lines 21 and 22.

The piece of tape 60 is helically wound so as to partially overlap itself at the edges thereof in the width direction. In the overlapping region, the resin layer 61 in the outer piece of tape 60 is on the outer periphery of the metal layer 62 in the inner piece of tape 60, so that the metal layers 62 in the inner and outer pieces of tape 60 are insulated from each other by the resin layer 61.

Although the outer conductive layer 6 includes a single piece of tape 60 in the example illustrated in FIGS. 7A to 7D, the outer conductive layer 6 may instead include a plurality of pieces (for example, two pieces) of tape 60. In such a case, one of the pieces of tape 60 and another one of the pieces of tape 60 are preferably helically wound in the opposite directions. In other words, one of the pieces of tape 60 and another one of the pieces of tape 60 are preferably wound crosswise such that the longitudinal directions thereof cross each other.

According to the present embodiment, the electromagnetic field of the common-mode signals that leaks from the slit 31 is disrupted by the outer conductive layer 6. Therefore, the energy of the common-mode signal components is reduced and the common-mode signal components are attenuated accordingly. Here, attenuation of the differential signal components is relatively small since leakage of the electromagnetic field generated by the differential signal components from the slit 31 is small. Accordingly, the common-mode signal components can be attenuated by an attenuation factor greater than that of the differential signal components. Therefore, according to the present embodiment, it is not necessary to arrange an auxiliary member for disrupting or absorbing the electromagnetic field around the cable.

The piece of tape 60 is helically wound around the outer periphery of the conductive layer 3A, and the metal layers 62 included in the overlapping portions of the piece of tape 60 are insulated from each other by the resin layer 61. Therefore, the current flows through the piece of tape 60 in a direction that obliquely crosses the slit 31. As a result, the attenuation of the common-mode signal components by the disruption of the electromagnetic field can be more effectively achieved. According to the present embodiment, the frequency characteristics of the attenuation of the common-mode signal components can be adjusted by adjusting the winding pitch, or winding angle, of the piece of tape 60. For example, when the winding pitch of the piece of tape 60 is p (m) and the propagation velocity of the common-mode signals is v (m/s), common-mode signals having a frequency of v/(2p) (Hz) or less can be effectively attenuated.

The differential signal transmission cable 10C may include the conductive layer 3 having the openings 30 (see FIGS. 2A to 2C) instead of the conductive layer 3A having the slit 31. The metal layer 62 may be a metal foil formed by plating a copper foil with a metal other than copper. The piece of tape 60 may be free from the resin layer 61, and the entirety thereof may be formed of a metal sheet (for example, a copper foil or a metal foil formed by plating a copper foil with a metal other than copper). The edge portions of the piece of tape 60 in the width direction may be folded.

Fifth Embodiment

A fifth embodiment of the present invention will now be described with reference to FIGS. 8A to 8C.

Figure 8A:
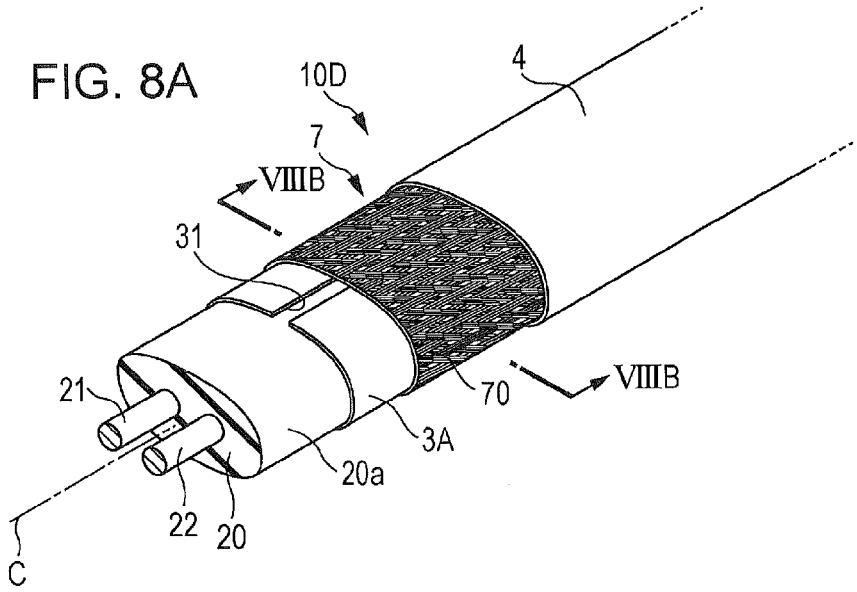
Figure 8B:
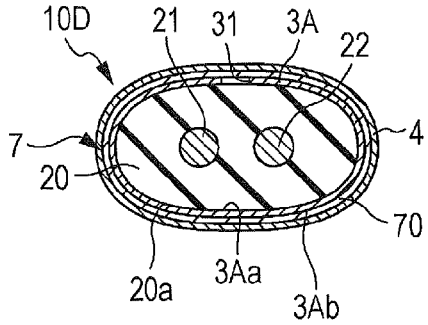
Figure 8C:
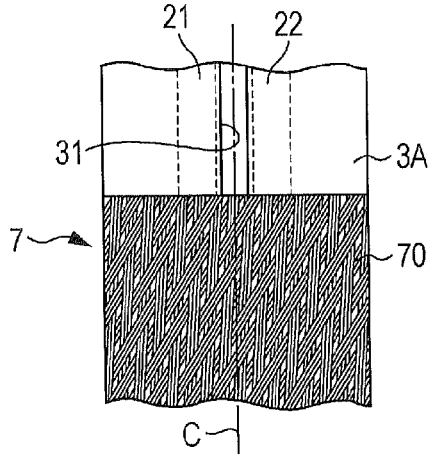

FIGS. 8A to 8C illustrate the structure of a differential signal transmission cable 10D according to the fifth embodiment. FIG. 8A is a perspective view of an end portion of the differential signal transmission cable 10D. FIG. 8B is a sectional view of FIG. 8A taken along line VIIIB-VIIIB. FIG. 8C is a side view of a conductive layer 3A viewed in a direction orthogonal to a direction in which first and second signal lines 21 and 22 are arranged. In FIGS. 8A to 8C, components having the same functions as those of the components described in the first and second embodiments are denoted by the same reference symbols, and explanations thereof are thus omitted.

The differential signal transmission cable 10D differs from the differential signal transmission cable 10A according to the second embodiment in that an outer conductive layer 7 formed of a braided conductor 70 is provided on the outer periphery of the conductive layer 3A. The braided conductor 70 has a hollow cylindrical shape and covers the outer periphery of the conductive layer 3A.

According to the present embodiment, the electromagnetic field of the common-mode signals that leaks from the slit 31 is disrupted by the outer conductive layer 7. Therefore, the energy of the common-mode signal components is reduced and the common-mode signal components are attenuated accordingly. Here, attenuation of the differential signal components is relatively small since leakage of the electromagnetic field generated by the differential signal components from the slit 31 is small. Accordingly, the common-mode signal components can be attenuated by an attenuation factor greater than that of the differential signal components. Therefore, according to the present embodiment, it is not necessary to arrange an auxiliary member for disrupting or absorbing the electromagnetic field around the cable.

The differential signal transmission cable 10D may include the conductive layer 3 having the openings 30 (see FIGS. 2A to 2C) instead of the conductive layer 3A having the slit 31.

Sixth Embodiment

A sixth embodiment of the present invention will now be described with reference to FIGS. 9A to 9C.

Figure 9A:
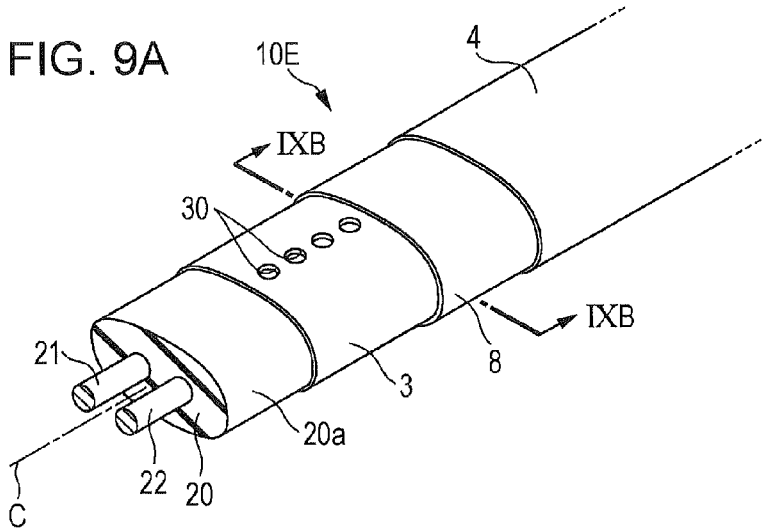
Figure 9B:
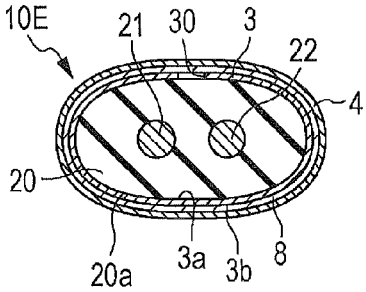
Figure 9C:
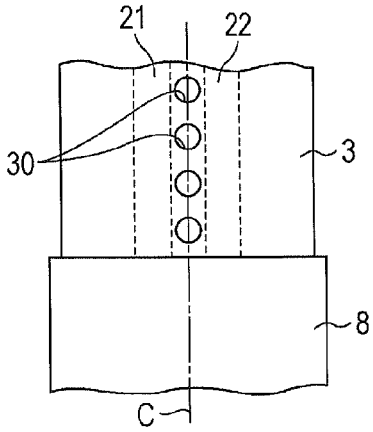

FIGS. 9A to 9C illustrate the structure of a differential signal transmission cable 10E according to the sixth embodiment. FIG. 9A is a perspective view of an end portion of the differential signal transmission cable 10E. FIG. 9B is a sectional view of FIG. 9A taken along line IXB-IXB. FIG. 9C is a side view of a conductive layer 3A viewed in a direction orthogonal to a direction in which first and second signal lines 21 and 22 are arranged. In FIGS. 9A to 9C, components having the same functions as those of the components described in the first embodiment are denoted by the same reference symbols, and explanations thereof are thus omitted.

The differential signal transmission cable 10E differs from the differential signal transmission cable 10 according to the first embodiment in that the outer periphery of the conductive layer 3 having the openings 30 is covered by an electromagnetic wave absorber 8. The electromagnetic wave absorber 8 has a hollow cylindrical shape and entirely covers the outer periphery of the conductive layer 3. The electromagnetic wave absorber 8 is made of, for example, ferrite or a resin in which ferrite particles are dispersed.

According to the present embodiment, the above-described effects and advantages of the first embodiment can be obtained. In addition, the electromagnetic field generated by the common-mode signal components of the signals that propagate through the first and second signal lines 21 and 22 can be absorbed by the electromagnetic wave absorber 8. Therefore, the common-mode signal components can be more effectively attenuated.

The differential signal transmission cable 10E may include the conductive layer 3A having the slit 31 (see FIGS. 5A to 5C) instead of the conductive layer 3 having the openings 30.

Seventh Embodiment

A seventh embodiment of the present invention will now be described with reference to FIGS. 10A and 10B.

Figure 10A:
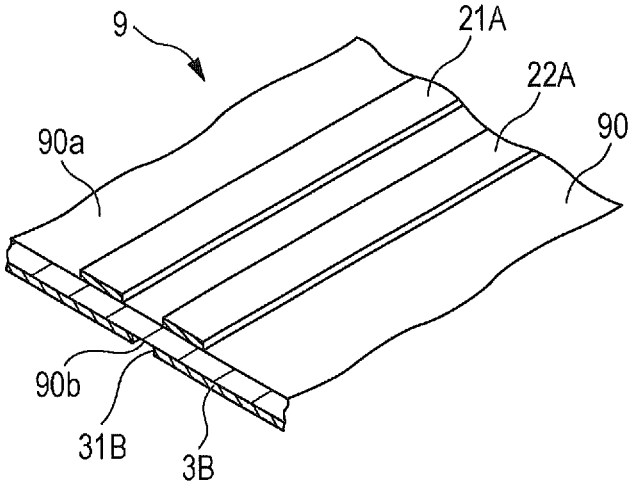
FIGS. 10A and 10B are a sectional perspective view and a plan view, respectively, illustrating the structure of a flexible flat cable according to a seventh embodiment.
Figure 10B:
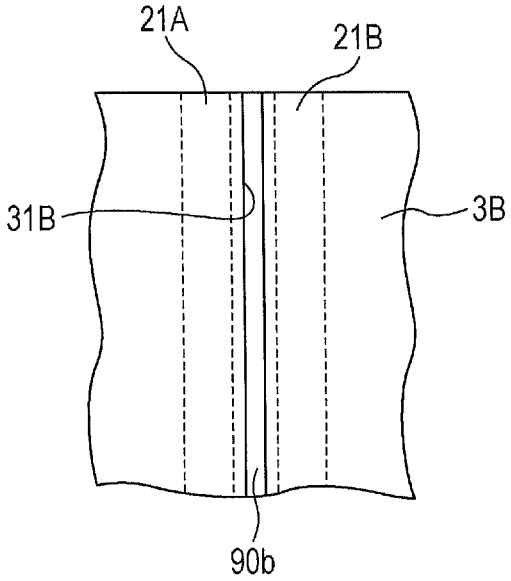

FIGS. 10A and 10B are a sectional perspective view and a plan view, respectively, illustrating the structure of a flexible flat cable 9 according to the seventh embodiment.

The flexible flat cable 9 includes a plate-shaped flexible base member 90, first and second signal lines 21A and 22A provided on a first principal surface 90*a* of the base member 90, and a conductive layer 3B formed of a conductor and provided on a second principal surface 90*b* (surface at the side opposite the first principal surface 90*a*) of the base member 90.

The base member 90 is made of, for example, a flexible insulating resin such as polyetherimide or polyethylene terephthalate, and functions as a dielectric interposed between the first and second signal lines 21A and 22A and the conductive layer 3B. The thickness of the base member 90 is, for example, 0.6 mm or less.

The first and second signal lines 21A and 22A are arranged on the first principal surface 90*a* of the base member 90 so as to extend parallel to each other with a predetermined gap therebetween. The first and second signal lines 21A and 22A are formed of, for example, a copper foil.

The conductive layer 3B has a band-shaped slit 31B, which is a non-continuous section of the conductor. As illustrated in FIG. 10B, when the flexible flat cable 9 is viewed from the second-principal-surface-90*b* side, the slit 31B is formed in an area between the first and second signal lines 21A and 22A. The longitudinal direction of the slit 31B is parallel to the direction in which the first and second signal lines 21A and 22A extend.

The slit 31B is formed in a region including the position that is equally spaced from the first and second signal lines 21A and 22A. In this region, the intensity of the current induced by the common-mode signals that propagate through the first and second signal lines 21A and 22A is higher than that in the surrounding regions. Since the slit 31B is formed in this region, similar to the first to sixth embodiments, the common-mode signal components of the signals that propagate through the first and second signal lines 21A and 22A can be attenuated by an attenuation factor greater than that of the differential signal components. As a result, the bit error rate at the reception side can be reduced.

Summary of Embodiments

The technical idea that can be understood from the above-described embodiments will now be described by using reference symbols used in the embodiments. However, the reference symbols do not limit the constituent elements of the claims to the components described in the embodiments.

[1] A differential signal transmission cable (10, 10A to 10E, 9) including a pair of signal lines (21, 21A, 22, 22A) arranged parallel to each other, a conductive layer (3, 3A, 3B) made of a conductor in which a current is induced when signals propagate through the pair of signal lines, and a dielectric (20, 90) disposed between the pair of signal lines and the conductive layer, wherein the conductive layer has a signal attenuating structure including a non-continuous section in which the conductor is non-continuous, the non-continuous section being located such that, among differential signal components and common-mode signal components included in the signals that propagate through the pair of signal lines, the common-mode signal components are attenuated by an attenuation factor greater than an attenuation factor of the differential signal components.

[2] The differential signal transmission cable according to [1], wherein the non-continuous section is formed in an area between the signal lines when the conductive layer is viewed in a direction orthogonal to a direction in which the signal lines are arranged.

[3] The differential signal transmission cable according to [1] or [2], wherein the non-continuous section has a plurality of openings (30).

[4] The differential signal transmission cable according to [1] or [2], wherein the non-continuous section has a linear slit (31, 31B).

[5] The differential signal transmission cable (10, 10A to 10E) according to any one of [1] to [4], further including an outer conductive layer (5, 6, 7) that covers the non-continuous section from an outer peripheral side of the conductive layer (3, 3A).

[6] The differential signal transmission cable (10E) according to any one of [1] to [4], further including an electromagnetic wave absorber (8) that covers the non-continuous section from an outer peripheral side of the conductive layer.

[7] The differential signal transmission cable (9) according to any one of [1] to [4], wherein the dielectric is a flexible plate-shaped base member (90), and wherein the pair of signal lines (21A, 22A) are provided on a first principal surface (90*a*) of the base member and the conductive layer (3B) is provided on a second principal surface (90*b*) of the base member.

[8] A multi-core differential signal transmission cable (100) including a plurality of the differential signal transmission cables (9, 10, 10A to 10E) according to any one of [1] to [7], the differential signal transmission cables being collectively shielded together.

[9] The differential signal transmission cable (10B) according to [5], wherein the outer conductive layer (5) includes a conductor wire (50) that is helically wrapped around the outer periphery of the conductive layer (3, 3A).

[10] The differential signal transmission cable (10C) according to [5], wherein the outer conductive layer (6) includes a piece of tape (60) that is helically wrapped around the outer periphery of the conductive layer (3, 3A) and that includes a metal layer.

[11] The differential signal transmission cable (10D) according to [5], wherein the outer conductive layer (7) includes a braided conductor (70) that covers the outer periphery of the conductive layer (3, 3A).

[12] The multi-core differential signal transmission cable according to [8], wherein the differential signal transmission cables are arranged such that the non-continuous sections thereof face outward with respect to a center (O) of the multi-core differential signal transmission cable.

Although the embodiments of the present invention are described above, the above-described embodiments do not limit the present invention that is defined by the claims. It is to be noted that not all of the combinations of the features described in the embodiments is essential to achieve the object of the present invention.

What is claimed is:

1. A differential signal transmission cable, comprising:

a pair of signal lines arranged parallel to each other;

a conductive layer comprising a conductor in which a current is induced when signals propagate through the pair of signal lines; and a dielectric disposed between the pair of signal lines and the conductive layer, wherein the conductive layer includes a signal attenuating structure including a non-continuous section in which the conductor is non-continuous, the non-continuous section being located such that, among differential signal components and common-mode signal components included in the signals propagating through the pair of signal lines, the common-mode signal components are attenuated by an attenuation factor greater than an attenuation factor of the differential signal components, and wherein an entirety of the non-continuous section is formed in an area between the pair of signal lines when the conductive layer is viewed in a direction orthogonal to a direction in which the signal lines are arranged.

2. The differential signal transmission cable according to claim 1, wherein the non-continuous section includes a plurality of openings.

3. The differential signal transmission cable according to claim 1, wherein the non-continuous section includes a linear slit.

4. The differential signal transmission cable according to claim 1, further comprising:

an outer conductive layer that covers the non-continuous section from an outer peripheral side of the conductive layer.

5. The differential signal transmission cable according to claim 1, further comprising:

an electromagnetic wave absorber that covers the non-continuous section from an outer peripheral side of the conductive layer.

6. The differential signal transmission cable according to claim 1, wherein the dielectric comprises a flexible plate-shaped base member, and wherein the pair of signal lines are provided on a first principal surface of the base member and the conductive layer is provided on a second principal surface of the base member.

7. A multi-core differential signal transmission cable, comprising:

a plurality of the differential signal transmission cables according to claim 1, the differential signal transmission cables being collectively shielded together.

8. The multi-core differential signal transmission cable according to claim 7, further comprising a shield conductor for collectively shielding the differential signal transmission cables together; and a braided wire tube disposed on an outer surface of the shield conductor.

9. The multi-core differential signal transmission cable according to claim 8, further comprising:

an insulator sheath disposed on an outer surface of the braided wire tube.

10. The multi-core differential signal transmission cable according to claim 7, wherein a group of the differential signal transmission cables are arranged in a central area of the multi-core differential signal transmission cable, and are disposed in a cylindrical enclosure.

11. The multi-core differential signal transmission cable according to claim 10, wherein a remaining group of differential signal transmission cables is arranged outside the enclosure such that the non-continuous section of each of the differential signal transmission cables in the remaining group faces toward a shield conductor that collectively shields the differential signal transmission cables together.

12. The multi-core differential signal transmission cable according to claim 10, wherein the non-continuous section of each of the differential signal transmission cables in the group of the differential signal transmission cables faces toward a shield conductor that collectively shields the differential signal transmission cables together.

13. The differential signal transmission cable according to claim 1, a braided wire tube disposed around the differential signal transmission cables.

14. The differential signal transmission cable according to claim 1, wherein the differential signal transmission cables is configured for a digital communication of about 10 Gbit/sec.

15. The differential signal transmission cable according to claim 1, wherein the conductive layer further includes a continuous section in which the conductor continuously extends circumferentially from an edge of the non-continuous section to another edge of the non-continuous section.

16. The differential signal transmission cable according to claim 1, wherein the conductive layer further includes a continuous section in which the conductor continuously extends circumferentially, between opposing edges of the non-continuous section, outside the area between the pair of signal lines.

17. The differential signal transmission cable according to claim 1, wherein the non-continuous section comprises through holes at which an outer peripheral surface of the dielectric is exposed to an outside of the conductive layer.

18. The differential signal transmission cable according to claim 1, further comprising:

a plurality of helically wrapped conductor wires provided on an outer periphery of the conductive layer.

19. The differential signal transmission cable according to claim 18, further comprising:

a jacket disposed on an outer surface of the plurality of helically wrapped conductor wires.

* * * * *